US008890785B2

(12) United States Patent
Lin et al.

(10) Patent No.: US 8,890,785 B2
(45) Date of Patent: Nov. 18, 2014

(54) DISPLAY PANEL AND GATE DRIVING CIRCUIT THEREOF

(75) Inventors: Kun-Yueh Lin, Chiayi County (TW); Chun-Hsin Liu, Yunlin County (TW); Chun-Huan Chang, New Taipei (TW); Ya-Ting Lin, Taichung (TW)

(73) Assignee: Au Optronics Corporation, Hsinchu (TW)

( * ) Notice: Subject to any disclaimer, the term of this patent is extended or adjusted under 35 U.S.C. 154(b) by 240 days.

(21) Appl. No.: 13/449,322

(22) Filed: Apr. 18, 2012

(65) Prior Publication Data

US 2013/0100006 A1 Apr. 25, 2013

(30) Foreign Application Priority Data

Oct. 21, 2011 (TW) ..... 100138263 A

(51) Int. Cl.
*G09G 3/36* (2006.01)
*G09G 3/20* (2006.01)

(52) U.S. Cl.
CPC ..... *G09G 3/3659* (2013.01); *G09G 2310/0286* (2013.01); *G09G 3/2074* (2013.01)
USPC ..... 345/94; 345/38; 345/206; 345/211; 349/38; 349/48

(58) Field of Classification Search
None
See application file for complete search history.

(56) References Cited

U.S. PATENT DOCUMENTS

| | | | | |
|---|---|---|---|---|
| 7,843,520 | B2 * | 11/2010 | Lu et al. | 349/38 |
| 8,427,416 | B2 * | 4/2013 | Tsou | 345/100 |
| 2009/0086116 | A1 * | 4/2009 | Pak | 349/38 |
| 2010/0315403 | A1 * | 12/2010 | Kaneyoshi et al. | 345/211 |
| 2011/0115998 | A1 * | 5/2011 | Liao et al. | 349/38 |
| 2011/0157124 | A1 * | 6/2011 | Jung et al. | 345/211 |
| 2011/0221721 | A1 * | 9/2011 | Tsou | 345/206 |
| 2012/0086627 | A1 * | 4/2012 | Chen et al. | 345/100 |

* cited by examiner

*Primary Examiner* — Kent Chang
*Assistant Examiner* — Benjamin Morales Fernandez
(74) *Attorney, Agent, or Firm* — Jianq Chyun IP Office

(57) ABSTRACT

A display panel and its gate driving circuit are provided. The gate driving circuit includes a plurality of shift registers. Each of the shift registers includes a first scan signal generator for generating a first scan signal, a second scan signal generator for generating a second scan signal, a first control unit for generating a first control signal, and a second control unit for generating a second control signal. Here, the first control signal and the second control signal are shared by the first scan signal generator and the second scan signal generator. Based on the above, the abatement of signal intensity of the first scan signal and the second scan signal caused by circuit sharing can be precluded, and a chip area occupied by each of the shift registers can be reduced.

20 Claims, 5 Drawing Sheets

DISPLAY PANEL AND GATE DRIVING CIRCUIT THEREOF

CROSS-REFERENCE TO RELATED APPLICATION

This application claims the priority benefit of Taiwan application serial no. 100138263, filed on Oct. 21, 2011. The entirety of the above-mentioned patent application is hereby incorporated by reference herein and made a part of this specification.

BACKGROUND OF THE INVENTION

1. Field of the Invention

The invention generally relates to a display panel and a gate driving circuit thereof. More particularly, the invention relates to a gate driving circuit located on a display panel and a display panel using the gate driving circuit.

2. Description of Related Art

In recent years, with great advance in the semiconductor-related technology, portable electronic devices and flat panel display (FDP) products have been rapidly developed. Among various types of FDPs, liquid crystal displays (LCDs) have gradually become the mainstream display products because of the advantages of low operating voltage, non-radiation, light weight, compact volume, etc. Accordingly, a fabricating method of the LCDs is developed towards miniaturization and low costs by manufacturers.

In order to reduce the manufacturing costs of the LCDs, some manufacturers aim at making multi-stage shift registers directly on a glass substrate of a panel, so as to replace the conventional gate drivers. Thereby, the manufacturing costs of the LCDs can be lowered down.

Since the shift registers are constituted by thin film transistors (TFTs) formed on the substrate, the driving capability of the shift registers are subject to the manufacturing process of the TFTs. To improve the frame rate, a single-stage shift register may output a plurality of scan signals to a plurality of scan lines, so as to simultaneously drive multiple rows of pixels. In addition, to resolve the color washout issue, each pixel is divided into a plurality of display regions, and therefore the single-stage shift register may need to output additional driving signals to the pixel, so as to regulate optical effects achieved in each display region. In view of the above, the single-stage shift register with the limited driving capability is required to output a plurality of scan signals and/or driving signals; therefore, due to the excessive load, the driving capability of the shift register may become insufficient.

SUMMARY OF THE INVENTION

The invention is directed to a display panel and its gate driving circuit which can prevent the abatement of signal intensity of scan signals caused by circuit sharing, and a chip area occupied by each first shift register can be reduced.

In the invention, a gate driving circuit located on a substrate is provided. The gate driving circuit is suitable for driving a pixel array that has a plurality of first pixels and a plurality of second pixels. Each of the first pixels is electrically connected to one of the first scan lines, one of the first data lines, and one of the first driving lines. Each of the second pixels is electrically connected to one of the second scan lines, one of the second data lines, and one of the second driving lines. The gate driving circuit includes a plurality of first shift registers and a plurality of second shift registers. Each of the first shift registers includes a first scan signal generator, a second scan signal generator, a first control unit, and a second control unit. The first scan signal generator and the second scan signal generator are electrically connected to a corresponding one of the first scan lines and a corresponding one of the second scan lines, respectively, so as to simultaneously output a first scan signal to the corresponding first scan line and output a second scan signal to the corresponding second scan line according to a plurality of clock signals. The first control unit generates a first control signal based on a first latch clock signal. The second control unit generates a second control signal based on a second latch clock signal. The first control signal and the second control signal are transmitted to the first scan signal generator and the second scan signal generator, respectively, so as to control the first scan signal generator and the second scan signal generator to stop outputting the first scan signal and the second scan signal. Each of the second shift registers includes a driving signal generator, a third control unit, and a fourth control unit. The driving signal generator is electrically connected to a corresponding one of the first driving lines and a corresponding one of the second driving lines for simultaneously outputting a first driving signal to the corresponding first driving line and outputting a second driving signal to the corresponding second driving line according to the clock signals. The third control unit generates a third control signal based on the first latch clock signal, and the fourth control unit generates a fourth control signal based on the second latch clock signal. The third control signal and the fourth control signal are transmitted to the driving signal generator, so as to control the driving signal generator to stop outputting the first driving signal and the second driving signal.

In the invention, a display panel that includes a substrate, a plurality of first scan lines, a plurality of second scan lines, a plurality of first data lines, a plurality of second data lines, a plurality of first driving lines, a plurality of second driving lines, a pixel array, and the gate driving circuit is provided. The first scan lines, the second scan lines, the first data lines, the second data lines, the first driving lines, the second driving lines, and the pixel array are all located on the substrate. The pixel array has a plurality of first pixels and a plurality of second pixels. Each of the first pixels is electrically connected to one of the first scan lines, one of the first data lines, and one of the first driving lines. Each of the second pixels is electrically connected to one of the second scan lines, one of the second data lines, and one of the second driving lines.

According to an embodiment of the invention, a first scan signal generator of an $n^{th}$ first shift register of the first shift registers includes a first transistor, a second transistor, a third transistor, a fourth transistor, a fifth transistor, a sixth transistor, a seventh transistor, an eighth transistor, and a first capacitor. A drain of the first transistor receives a first clock signal of the clock signals, and a gate of the first transistor receives a first terminal voltage of an $(n-2)^{th}$ first shift register of the first shift registers. A drain of the second transistor electrically receives a first scan signal output by the $(n-2)^{th}$ first shift register, a gate of the second transistor is electrically connected to a source of the first transistor, and a source of the second transistor outputs the first terminal voltage of the $n^{th}$ first shift register. A drain of the third transistor receives a second clock signal of the clock signals, a gate of the third transistor is electrically connected to the source of the second transistor, and a source of the third transistor outputs a corresponding one of the first scan signals. The first capacitor is electrically connected between the gate and the source of the third transistor. A drain of the fourth transistor is electrically connected to the gate of the third transistor, a gate of the fourth transistor receives the first control signal, and a source of the fourth transistor is electrically connected to the source of the third transistor. A drain of the fifth transistor is electrically connected to the source of the third transistor, a gate of the fifth transistor receives the first control signal, and a source of the fifth transistor receives a reference voltage. A drain of the sixth transistor is electrically connected to the gate of the third transistor, a gate of the sixth transistor receives the second control signal, and a source of the sixth transistor is electrically connected to the source of the third transistor. A drain of the seventh transistor is electrically connected to the source of the third transistor, a gate of the seventh transistor receives the second control signal, and a source of the seventh transistor receives the reference voltage. A drain of the eighth transistor is electrically connected to the gate of the third transistor, a gate of the eighth transistor receives a first driving signal output by an $(n-2)^{th}$ second shift register of the second shift registers, and a source of the eighth transistor receives the reference voltage. Here, n is a positive integer greater than or equal to 1.

According to an embodiment of the invention, a second scan signal generator of the $n^{th}$ first shift register includes a ninth transistor, a tenth transistor, an eleventh transistor, a twelfth transistor, a thirteenth transistor, a fourteenth transistor, a fifteenth transistor, a sixteenth transistor, and a second capacitor. A drain of the ninth transistor receives the first clock signal, and a gate of the ninth transistor receives a second terminal voltage of the $(n-2)^{th}$ first shift register. A drain of the tenth transistor electrically receives a second scan signal output by the $(n-2)^{th}$ first shift register, a gate of the tenth transistor is electrically connected to a source of the ninth transistor, and a source of the tenth transistor outputs the second terminal voltage of the $n^{th}$ first shift register. A drain of the eleventh transistor receives the second clock signal, a gate of the eleventh transistor is electrically connected to the source of the tenth transistor, and a source of the eleventh transistor outputs a corresponding one of the second scan signals. The second capacitor is electrically connected between the gate and the source of the eleventh transistor. A drain of the twelfth transistor is electrically connected to the gate of the eleventh transistor, a gate of the twelfth transistor receives the first control signal, and a source of the twelfth transistor is electrically connected to the source of the eleventh transistor. A drain of the thirteenth transistor is electrically connected to the source of the eleventh transistor, a gate of the thirteenth transistor receives the first control signal, and a source of the thirteenth transistor receives the reference voltage. A drain of the fourteenth transistor is electrically connected to the gate of the eleventh transistor, a gate of the fourteenth transistor receives the second control signal, and a source of the fourteenth transistor is electrically connected to the source of the eleventh transistor. A drain of the fifteenth transistor is electrically connected to the source of the eleventh transistor, a gate of the fifteenth transistor receives the second control signal, and a source of the fifteenth transistor receives the reference voltage. A drain of the sixteenth transistor is electrically connected to the gate of the eleventh transistor, a gate of the sixteenth transistor receives a second driving signal output by the $(n-2)^{th}$ second shift register, and a source of the sixteenth transistor receives the reference voltage.

According to an embodiment of the invention, a driving signal generator of an $n^{th}$ second shift register of the second shift registers includes a seventeenth transistor, an eighteenth transistor, a nineteenth transistor, a twentieth transistor, a twenty-first transistor, a twenty-second transistor, a twenty-third transistor, a twenty-fourth transistor, a twenty-fifth transistor, a twenty-sixth transistor, a twenty-seventh transistor, a twenty-eighth transistor, a twenty-ninth transistor, a thirtieth transistor, a third capacitor, and a fourth capacitor. A drain of the seventeenth transistor receives the first clock signal, and a gate of the seventeenth transistor receives a third terminal voltage of the $(n-2)^{th}$ second shift register. A drain of the eighteenth transistor electrically receives a first driving signal output by the $(n-2)^{th}$ second shift register, a gate of the eighteenth transistor is electrically connected to a source of the seventeenth transistor, and a source of the eighteenth transistor outputs the third terminal voltage of the $n^{th}$ second shift register. A drain of the nineteenth transistor receives the first clock signal, and a gate of the nineteenth transistor receives the third terminal voltage of the $(n-2)^{th}$ second shift register. A drain of the twentieth transistor electrically receives a second driving signal output by the $(n-2)^{th}$ second shift register, a gate of the twentieth transistor is electrically connected to a source of the nineteenth transistor, and a source of the twentieth transistor is electrically connected to the source of the eighteenth transistor. A drain of the twenty-first transistor receives the second clock signal, a gate of the twenty-first transistor is electrically connected to the source of the eighteenth transistor, and a source of the twenty-first transistor outputs a corresponding one of first driving signals. A drain of the twenty-second transistor receives the second clock signal, a gate of the twenty-second transistor is electrically connected to the gate of the twenty-first transistor, and a source of the twenty-second transistor outputs a corresponding one of second driving signals. The third capacitor is electrically connected between the gate and the source of the twenty-first transistor. The fourth capacitor is electrically connected between the gate and the source of the twenty-second transistor. A drain of the twenty-third transistor is electrically connected to the gate of the twenty-first transistor, a gate of the twenty-third transistor receives the third control signal, and a source of the twenty-third transistor is electrically connected to the source of the twenty-first transistor. A drain of the twenty-fourth transistor is electrically connected to the source of the twenty-first transistor, a gate of the twenty-fourth transistor receives the third control signal, and a source of the twenty-fourth transistor receives the reference voltage. A drain of the twenty-fifth transistor is electrically connected to the source of the twenty-second transistor, a gate of the twenty-fifth transistor receives the third control signal, and a source of the twenty-fifth transistor receives the reference voltage. A drain of the twenty-sixth transistor is electrically connected to the gate of the twenty-first transistor, a gate of the twenty-sixth transistor receives the fourth control signal, and a source of the twenty-sixth transistor is electrically connected to the source of the twenty-second transistor. A drain of the twenty-seventh transistor is electrically connected to the source of the twenty-first transistor, a gate of the twenty-seventh transistor receives the fourth control signal, and a source of the twenty-seventh transistor receives the reference voltage. A drain of the twenty-eighth transistor is electrically connected to the source of the twenty-second transistor, a gate of the twenty-eighth transistor receives the fourth control signal, and a source of the twenty-eighth transistor receives the reference voltage. A drain of the twenty-ninth transistor is electrically connected to the gate of the twenty-first transistor, a gate of the twenty-ninth transistor receives a first driving signal output by an $(n+4)^{th}$ second shift register of the second shift registers, and a source of the twenty-ninth transistor receives the reference voltage. A drain of the thirtieth transistor is electrically connected to the gate of the twenty-second transistor, a gate of the thirtieth transistor receives a second driving signal output by the $(n+4)^{th}$ second shift register, and a source of the thirtieth transistor receives the reference voltage.

According to an embodiment of the invention, the first control unit, the second control unit, the third control unit, and the fourth control unit respectively includes a thirty-first transistor, a thirty-second transistor, a thirty-third transistor, and a thirty-fourth transistor. A gate of the thirty-first transistor is electrically connected to a drain of the thirty-first transistor. A drain of the thirty-second transistor is electrically connected to the drain of the thirty-first transistor, a gate of the thirty-second transistor is electrically connected to a source of the thirty-first transistor, and a source of the thirty-second transistor correspondingly outputs one of the first control signal, the second control signal, the third control signal, and the fourth control signal. A drain of the thirty-third transistor is electrically connected to the source of the thirty-first transistor, and a source of the thirty-third transistor receives the reference voltage. A drain of the thirty-fourth transistor is electrically connected to the source of the thirty-second transistor, a gate of the thirty-fourth transistor is electrically connected to a gate of the thirty-third transistor, and a source of the thirty-fourth transistor receives the reference voltage. The gates of the thirty-first transistors of the first control unit and the third control unit receive the first latch clock signal. The gates of the thirty-first transistors of the second control unit and the fourth control unit receive the second latch clock signal. The gate of the thirty-third transistor of the first control unit receives the second terminal voltage of the nth first shift register. The gate of the thirty-third transistor of the second control unit receives the first terminal voltage of the $n^{th}$ first shift register. The gates of the thirty-third transistors of the third control unit and the fourth control unit receive the third terminal voltage of the $n^{th}$ second shift register.

According to an embodiment of the invention, first pixels and the second pixels respectively include a thirty-fifth transistor, a thirty-sixth transistor, a thirty-seventh transistor, a first storage capacitor, a first liquid crystal capacitor, a second storage capacitor, a second liquid crystal capacitor, a fifth capacitor, and a sixth capacitor. The first storage capacitor is electrically connected between a source of the thirty-fifth transistor and a common voltage. The first liquid crystal capacitor is electrically connected between the source of the thirty-fifth transistor and the common voltage. The fifth capacitor and the sixth capacitor are electrically connected in series between the source of the thirty-fifth transistor and the common voltage. The second storage capacitor is electrically connected between a source of the thirty-sixth transistor and the common voltage. The second liquid crystal capacitor is electrically connected between the source of the thirty-sixth transistor and the common voltage. A drain of the thirty-seventh transistor is electrically connected to the source of the thirty-sixth transistor, and a source of the thirty-seventh transistor is electrically connected between the fifth capacitor and the sixth capacitor. A gate of the thirty-fifth transistor and a gate of the thirty-sixth transistor of each of the first pixels are electrically connected to a corresponding one of the first scan lines. A drain of the thirty-fifth transistor and a drain of the thirty-sixth transistor of each of the first pixels are electrically connected to a corresponding one of the first data lines. A gate of the thirty-seventh transistor of each of the first pixels is electrically connected to a corresponding one of the first driving lines. A gate of the thirty-fifth transistor and a gate of the thirty-sixth transistor of each of the second pixels are electrically connected to a corresponding one of the second scan lines. A drain of the thirty-fifth transistor and a drain of the thirty-sixth transistor of each of the second pixels are electrically connected to a corresponding one of the second data lines. A gate of the thirty-seventh transistor of each of the second pixels is electrically connected to a corresponding one of the second driving line.

According to an embodiment of the invention, the first scan signal and the second scan signal do not overlap a corresponding one of the first driving signals and a corresponding one of the second driving signals.

According to an embodiment of the invention, the first scan signal and the second scan signal are output before the corresponding first driving signal and the corresponding second driving signal are output, and there is a clock period of the clock signals between a time point at which the first and second scan signals are output and a time point at which the corresponding first and second driving signals are output.

According to an embodiment of the invention, the first latch clock signal is an inverted signal of the second latch clock signal.

According to an embodiment of the invention, the clock signals are output sequentially.

According to an embodiment of the invention, each of the clock signals overlaps two clock signals adjacent thereto.

According to an embodiment of the invention, overlapping portions of each of the clock signals and the two adjacent clock signals are equal, and a total value of the overlapping portions of each of the clock signals and the two adjacent clock signals is equal to a pulse width of one of the clock signals.

According to an embodiment of the invention, the first data lines and the second data lines are alternately arranged, and the first data lines and the second data lines are perpendicular to the first driving lines and the second driving lines.

According to an embodiment of the invention, the first driving lines and the second driving lines are parallel to the first scan lines and the second scan lines, and the first driving lines, the second driving lines, the first scan lines, and the second scan lines are alternately arranged.

As described in the embodiments of the invention, each of the first shift registers in the display panel and its gate driving circuit includes a first scan signal generator that generates a first scan signal and a second scan signal generator that generates a second scan signal. Besides, each of the first shift registers shares a first control unit and a second control unit. Thereby, the abatement of signal intensity of the first scan signal and the second scan signal caused by circuit sharing can be precluded, and a chip area occupied by each of the first shift registers can be reduced.

In order to make the aforementioned and other features and advantages of the invention more comprehensible, embodiments accompanying figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF EMBODIMENTS

Figure 1:
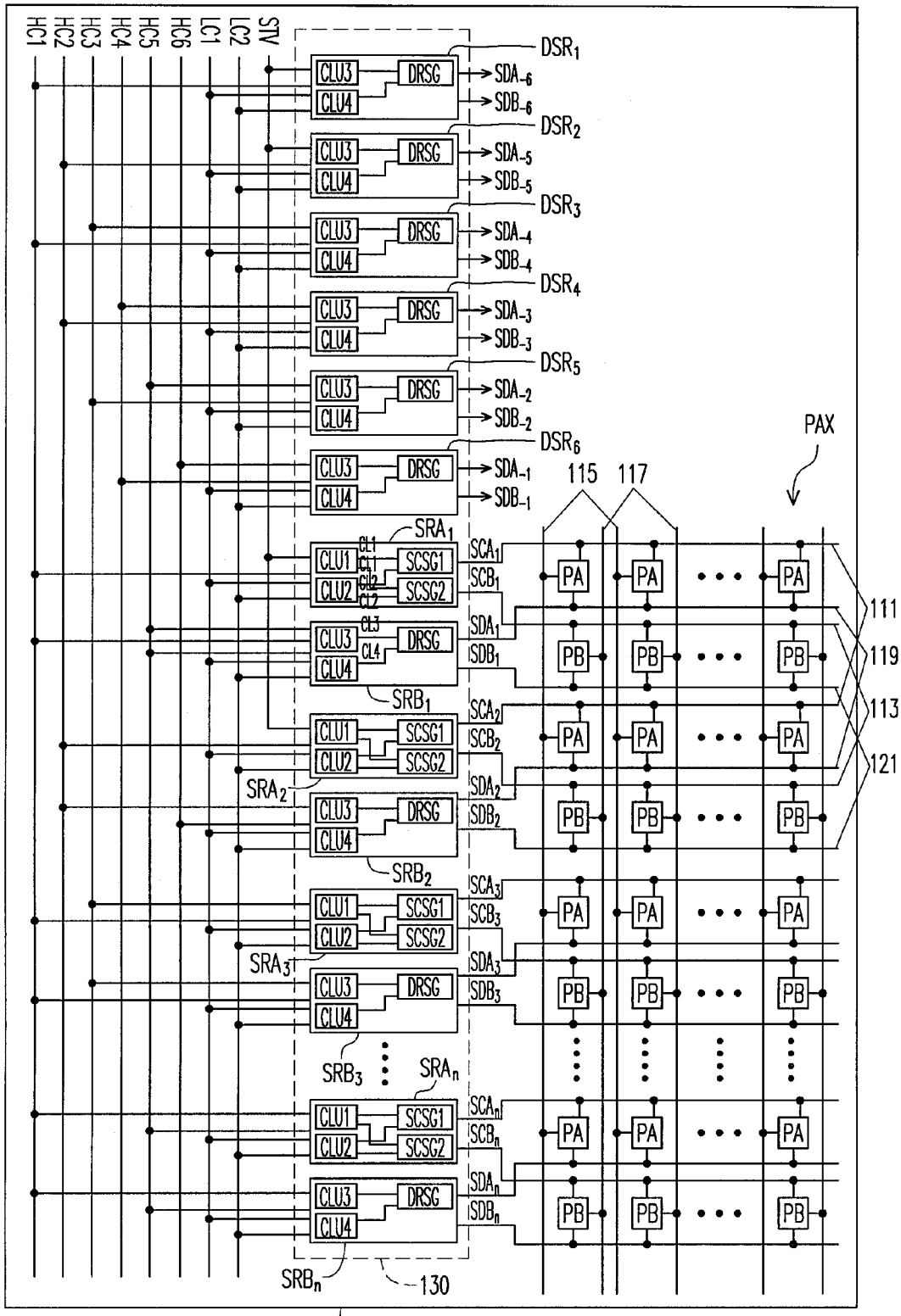
FIG. 1 is a schematic diagram illustrating circuits in a display panel according to an embodiment of the invention.

FIG. 1 is a schematic diagram illustrating circuits in a display panel according to an embodiment of the invention. With reference to FIG. 1, in this embodiment, a display panel 100 includes a substrate 110, a plurality of first scan lines 111, a plurality of second scan lines 113, a plurality of first data lines 115, a plurality of second data lines 117, a plurality of first driving lines 119, a plurality of second driving lines 121, a pixel array PAX, and a gate driving circuit 130. A plurality of wires are configured on the display panel 100 to transmit a start signal STV, a plurality of clock signals HC1~HC6, a first latch clock signal LC1, and a second latch clock signal LC2.

In this embodiment, the first scan lines 111, the second scan lines 113, the first data lines 115, the second data lines 117, the first driving lines 119, the second driving lines 121, the pixel array PAX, and the gate driving circuit 130 are all located on the substrate 110. The first data lines 115 and the second data lines 117 are parallel and alternately arranged from left to right in a horizontal direction, as indicated in FIG. 1. The first scan lines 111, the second scan lines 113, the first driving lines 119, and the second driving lines 121 are parallel and alternately arranged from top to bottom in a vertical direction, as indicated in FIG. 1. In FIG. 1, the first data lines 115 and the second data lines 117 are perpendicular to the first scan lines 111, the second scan lines 113, the first driving lines 119, and the second driving lines 121.

Additionally, in this embodiment, the gate driving circuit 130 is located at one side of the pixel array PAX, while the gate driving circuit 130 may be configured at both sides of the pixel array PAX in another embodiment, such that the same scan signals (e.g., $SCA_1$ and $SCB_1$) and/or the same driving signals (e.g., $SDA_1$ and $SDB_1$) are input to the pixel array PAX from the two sides. Thereby, the signal intensity of the scan signals (e.g., $SCA_1$ and $SCB_1$) and the driving signals (e.g., $SDA_1$ and $SDB_1$) may be enhanced.

The pixel array PAX has a plurality of first pixels PA and a plurality of second pixels PB. According to the configuration of the first scan lines 111, the second scan lines 113, the first driving lines 119, and the second driving lines 121, the first pixels PA and the second pixels PB are located at different rows, such that each of the first pixels PA is electrically connected to a corresponding one of the first scan lines 111 and a corresponding one of the first driving lines 119, and that each of the second pixels PB is electrically connected to a corresponding one of the second scan lines 113 and a corresponding one of the second driving lines 121. Each of the first pixels PA is electrically connected to a corresponding one of the first data lines 115, and each of the second pixels PB is electrically connected to a corresponding one of the second data lines 117.

The gate driving circuit 130 includes a plurality of first shift registers $SRA_1$~$SRA_n$ and a plurality of second shift registers $SRB_1$~$SRB_n$. Here, n is a positive integer greater than or equal to 3. The first shift registers $SRA_1$~$SRA_n$ sequentially output high-level first scan signals $SCA_1$~$SCA_n$ to the corresponding first scan lines 111 and sequentially output high-level second scan signals $SCB_1$~$SCB_n$ to the corresponding second scan lines 113. The second shift registers $SRB_1$~$SRB_n$ sequentially output high-level first driving signals $SDA_1$~$SDA_n$ to the corresponding first driving lines 119 and sequentially output high-level second driving signals $SDB_1$~$SDB_n$ to the corresponding second driving lines 121.

In some embodiments, given that each of the first shift registers $SRA_1$~$SRA_n$ and each of the second shift registers $SRB_1$~$SRB_n$ are designed to operate based on the internal voltages or driving signals of the second shift registers at previous stages (e.g., two preceding stages), the gate driving circuit 130 may further include at least two-stage backup shift registers (e.g., $DSR_1$~$DSR_6$), so as to generate the internal voltages or the driving signals (e.g., $SDA_{-1}$, $SDA_{-2}$, $SDB_{-1}$, and $SDB_{-2}$) required for operating the last two first shift registers (e.g., $SRA_1$) and/or the last two second shift registers (e.g., $SRB_1$). According to this embodiment, it is assumed the gate driving circuit 130 includes six-stage backup shift registers (e.g., $DSR_1$~$DSR_6$) for respectively generating the first driving signals $SDA_{-6}$~$SDA_{-1}$ and the second driving signals $SDB_{-6}$~$SDB_{-1}$.

As indicated in FIG. 1, each of the first shift registers $SRA_1$~$SRA_n$ includes a first scan signal generator SCSG1, a second scan signal generator SCSG2, a first control unit CLU1, and a second control unit CLU2. The first scan signal generator SCSG1 and the second scan signal generator SCSG2 are electrically connected to a corresponding one of the first scan lines 111 and a corresponding one of the second scan lines 113, respectively, so as to simultaneously output the corresponding high-level first scan signal (e.g., $SCA_1$~$SCA_n$) to the corresponding first scan line 111 and output the corresponding high-level second scan signal (e.g., $SCB_1$~$SCB_n$) to the corresponding second scan line 113 according to the corresponding signal (e.g., the start signal STV or the clock signals HC1~HC6).

The first control unit CLU1 generates a first control signal CL1 based on a first latch clock signal LC1. The second control unit CLU2 generates a second control signal CL2 based on a second latch clock signal LC2. The first control signal CL1 and the second control signal CL2 are transmitted to the first scan signal generator SCSG1 and the second scan signal generator SCSG2, respectively, so as to control the first scan signal generator SCSG1 and the second scan signal generator SCSG2 to output the corresponding low-level first scan signal (e.g., $SCA_1$~$SCA_n$) and the corresponding low-level second scan signal (e.g., $SCB_1$~$SCB_n$). Here, the effect of outputting the low-level first scan signal (e.g., $SCA_1$~$SCA_n$) and the low-level second scan signal (e.g., $SCB_1$~$SCB_n$) is equal to the effect of stopping outputting the first scan signal (e.g., $SCA_1$~$SCA_n$) and the second scan signal (e.g., $SCB_1$~$SCB_n$).

Based on the above, each of the first shift registers $SRA_1$~$SRA_n$ includes the first scan signal generator SCSG1 that generates the first scan signal (e.g., $SCA_1$~$SCA_n$) and the second scan signal generator SCSG2 that generates the second scan signal (e.g., $SCB_1$~$SCB_n$). Besides, each of the first shift registers $SRA_1$~$SRA_n$ shares the first control signal CL1 of the first control unit CLU1 and the second control signal CL2 of the second control unit CLU2. Thereby, the abatement of signal intensity of the first scan signal (e.g., $SCA_1$~$SCA_n$) and the second scan signal (e.g., $SCB_1$~$SCB_n$) caused by circuit sharing can be precluded, and a chip area occupied by each of the first shift registers $SRA_1$~$SRA_n$ can be reduced.

Each of the second shift registers $SRB_1$~$SRB_n$ includes a driving signal generator DRSG, a third control unit CLU3, and a fourth control unit CLU4. The driving signal generator DRSG is electrically connected to a corresponding one of the first driving lines 119 and a corresponding one of the second driving lines 121, respectively, so as to simultaneously output the high-level first driving signal (e.g., $SDA_1$~$SDA_n$) to the corresponding first driving line 119 and output the high-level second driving signal (e.g., $SDB_1$~$SDB_n$) to the corresponding second driving line 121 according to a corresponding signal (e.g., the start signal STV or the clock signals HC1~HC6). The third control unit CLU3 generates a third control signal CL3 based on the first latch clock signal LC1. The fourth control unit CLU4 generates a fourth control signal CL4 based on the second latch clock signal LC2. The third control signal CL3 and the fourth control signal CL4 are transmitted to the driving signal generator DRSG, so as to control the driving signal generator DRSG to output the corresponding low-level first driving signal (e.g., $SDA_1$~$SDA_n$) and the corresponding low-level second driving signal (e.g., $SDB_1$~$SDB_n$). Here, the effect of outputting the low-level first driving signal (e.g., $SDA_1$~$SDA_n$) and the low-level second driving signal (e.g., $SDB_1$~$SDB_n$) is equal to the effect of stopping outputting the first driving signal (e.g., $SDA_1$~$SDA_n$) and the second driving signal (e.g., $SDB_1$~$SDB_n$).

Figure 2:
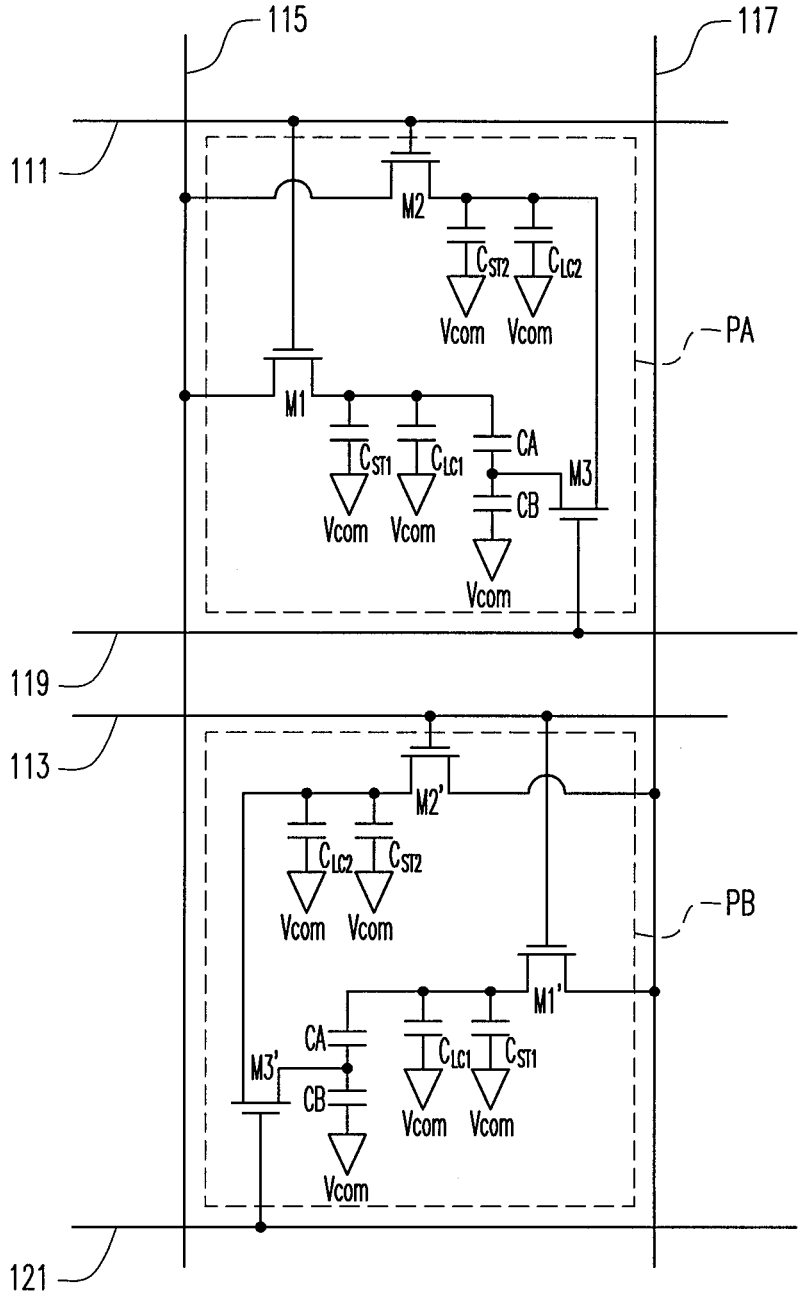
FIG. 2 is a schematic diagram illustrating circuits in the first and second pixels shown in FIG. 1 according to an embodiment of the invention.

FIG. 2 is a schematic diagram illustrating circuits in the first and second pixels shown in FIG. 1 according to an embodiment of the invention. With reference to FIG. 1 and FIG. 2, in this embodiment, the first pixel PA includes transistors M1, M2, M3 (a thirty-fifth transistor, a thirty-sixth transistor and a thirty-seventh transistor), storage capacitors $C_{ST1}$ and $C_{ST2}$, liquid crystal capacitors $C_{LC1}$ and $C_{LC2}$, and capacitors CA and CB. The gates of the transistors M1 and M2 are electrically connected to the corresponding first scan line 111, and the drains of the transistors M1 and M2 are electrically connected to the corresponding first data line 115. The storage capacitor $C_{ST1}$ and the liquid crystal capacitor $C_{LC1}$ are electrically connected between the source of the transistor M1 and a common voltage Vcom. The storage capacitor $C_{ST2}$ and the liquid crystal capacitor $C_{LC2}$ are electrically connected between the source of the transistor M2 and the common voltage Vcom. The capacitors CA and CB are electrically connected in series between the source of the transistor M1 and the common voltage Vcom. The gate of the transistor M3 is electrically connected to the first driving line 119, the drain of the transistor M3 is electrically connected to the source of the transistor M2, and the source of the transistor M3 is electrically connected between the capacitors CA and CB.

As indicated in FIG. 2, the structure of the second pixel PB is similar to the structure of the first pixel PA, while the difference therebetween lies in the connection correlation between the transistors M1', M2' and M3' and the corresponding lines. In the second pixel PB, the gates of the transistors M1' and M2' are electrically connected to the corresponding second scan line 113, the drains of the transistors M1' and M2' are electrically connected to the corresponding second data line 117, and the gate of the transistor M3' is electrically connected to the second driving line 121.

Based on the above, when the first scan line 111 receives the corresponding first scan signal (e.g., $SCA_1$), the storage capacitors $C_{ST1}$ and $C_{ST2}$ and the liquid crystal capacitors $C_{LC1}$ and $C_{LC2}$ of the first pixel PA can receive the pixel voltage (not shown) transmitted via the first data line 115; when the second scan line 113 receives the corresponding second scan signal (e.g., $SCB_1$), the storage capacitors $C_{ST1}$ and $C_{ST2}$ and the liquid crystal capacitors $C_{LC1}$ and $C_{LC2}$ of the second pixel PB can receive the pixel voltage (not shown) transmitted via the second data line 117. Thereby, the storage capacitors $C_{ST1}$ and $C_{ST2}$ and the liquid crystal capacitors $C_{LC1}$ and $C_{LC2}$ of the first pixel PA and the second pixel PB can be charged simultaneously, so as to increase the time of charging the first pixel PA and the second pixel PB.

Besides, when the first driving line 119 receives the corresponding first driving signal (e.g., $SDA_1$), and the second driving line 121 receives the corresponding second driving signal (e.g., $SDB_1$), voltages of the storage capacitor $C_{ST2}$ and the liquid crystal capacitor $C_{LC2}$ of the first pixel PA and the second pixel PB are lowered down due to the influence of the capacitor CB. Thereby, the optical effect achieved in the display regions of the first and second pixels PA and PB corresponding to the storage capacitor $C_{ST2}$ and the liquid crystal capacitor $C_{LC2}$ can be adjusted, and accordingly the color washout phenomenon of the polarizing display panel 100 can be alleviated.

Figure 3:
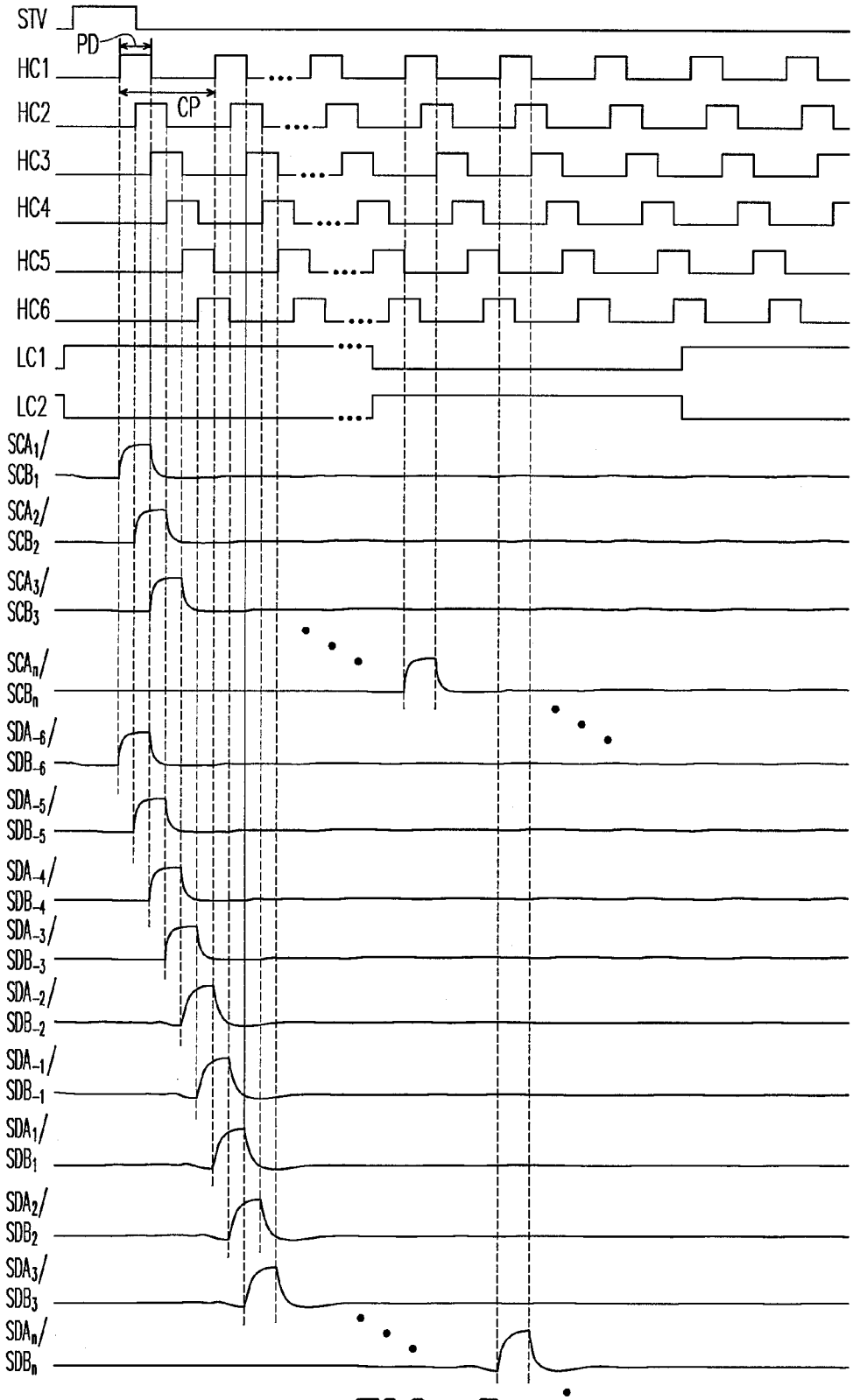
FIG. 3 is a schematic diagram illustrating waveforms of the clock signals, the scan signals, and the driving signals shown in FIG. 1 according to an embodiment of the invention.

FIG. 3 is a schematic diagram illustrating waveforms of the clock signals, the scan signals, and the driving signals shown in FIG. 1 according to an embodiment of the invention. With reference to FIG. 1 and FIG. 3, in this embodiment, each of the first shift registers (e.g., $SRA_1$~$SRA_n$) respectively receives the corresponding clock signals (e.g., HC1~HC6), and the first shift registers $SRA_1$~$SRA_n$ respectively output the high-level first scan signals (e.g., $SCA_1$~$SCA_n$) and the high-level second scan signals (e.g., $SCB_1$~$SCB_n$) according to the corresponding clock signals (e.g., HC1~HC6). Therefore, the scan signals (e.g., $SCA_1$~$SCA_n$ and $SCB_1$~$SCB_n$) appear to the same waveform. Additionally, each of the second shift registers (e.g., $SRB_1$~$SRB_n$) respectively receives the corresponding clock signals (e.g., HC1~HC6), and the second shift registers $SRB_1$~$SRB_n$ respectively output the high-level first driving signals (e.g., $SDA_1$~$SDA_n$) and the high-level second driving signals (e.g., $SDB_1$~$SDB_n$) according to the corresponding clock signals HC1~HC6. Therefore, the driving signals (e.g., $SDA_1$~$SDA_n$ and $SDB_1$~$SDB_n$) appear to the same waveform.

The start signal STV serves to sequentially turn on the first shift registers $SRA_1$~$SRA_n$ and sequentially turn on the second shift registers $SRB_1$~$SRB_n$. The first latch clock signal LC1 and the second latch signal LC2 serve to sequentially turn off the first shift registers $SRA_1$~$SRA_n$ and sequentially turn off the second shift registers $SRB_1$~$SRB_n$ according to the internal voltages of the first shift registers $SRA_1$~$SRA_n$ and the second shift registers $SRB_1$~$SRB_n$. The start signal STV, the first latch clock signal, and the second latch clock signal can be provided by a timing controller or a circuit board, which is determined based on actual requirements.

With reference to FIG. 3, in this embodiment, the first latch clock signal LC1 is an inverted signal of the second latch clock signal LC2. Pulses of the clock signals HC1~HC6 are sequentially formed. Namely, the high-level clock signals HC1~HC6 are output sequentially. Here, each of the clock signals (e.g., HC1~HC6) and two adjacent clock signals are overlapped, and overlapping portions between each of the clock signals (e.g., HC1~HC6) and the two adjacent clock signals are equal. Besides, a total value of the overlapping portions between each of the clock signals (e.g., HC1~HC6) and the two adjacent clock signals is equal to a pulse width PD of one of the clock signals (e.g., HC1~HC6). Thereby, each of the first scan signals (e.g., $SCA_1$~$SCA_n$) is overlapped with the previous first scan signal, so as to increase the time of charging the first pixel PA; each of the second scan signals (e.g., $SCB_1$~$SCB_n$) is overlapped with the previous second scan signal, so as to increase the time of charging the second pixel PB.

According to this embodiment, the first driving signals (e.g., $SDA_1$~$SDA_n$) and the second driving signals (e.g., $SDB_1$~$SDB_n$) serve to adjust optical effects of the first pixels PA and the second pixels PB, and the first driving signals (e.g., $SDA_1$~$SDA_n$) and the second driving signals (e.g., $SDB_1$~$SDB_n$) are different from the first scan signals (e.g., $SCA_1$~$SCA_n$) and the second scan signals (e.g., $SCB_1$~$SCB_n$) that serve to turn on the first pixels PA and the second pixels PB. Hence, each of the first scan signals (e.g., $SCA_1$~$SCA_n$) and each of the second scan signals (e.g., $SCB_1$~$SCB_n$) do not overlap a corresponding one of the first driving signals (e.g., $SDA_1$~$SDA_n$) and a corresponding one of the second driving signals (e.g., $SDB_1$~$SDB_n$). For instance, the first scan signal $SCA_1$ and the second scan signal $SCB_1$ are not overlapped with the first driving signal $SDA_1$ and the second driving signal $SDB_1$.

In general, after pixel voltages are correspondingly written into the first and second pixels PA and PB, the optical effects of the first and second pixels PA and PB are adjusted. Hence, the pulse of the first scan signals (e.g., $SCA_1$~$SCA_n$) and the pulse of the second scan signals (e.g., $SCB_1$~$SCB_n$) are formed before the pulse of the first driving signals (e.g., $SDA_1$~$SDA_n$) and the pulse of the second driving signals (e.g., $SDB_1$~$SDB_n$) are formed. That is to say, the high-level first scan signals (e.g., $SCA_1$~$SCA_n$) and the high-level second scan signals (e.g., $SCB_1$~$SCB_n$) are output before the corresponding high-level first driving signals (e.g., $SDA_1$~$SDA_n$) and the corresponding high-level second driving signals (e.g., $SDB_1$~$SDB_n$) are output. In addition, there is a clock period CP between a time point at which the high-level first scan signals (e.g., $SCA_1$~$SCA_n$) and the high-level second scan signals (e.g., $SCB_1$~$SCB_n$) are output and a time point at which the corresponding high-level first driving signals (e.g., $SDA_1$~$SDA_n$) and the corresponding high-level second driving signals (e.g., $SDB_1$~$SDB_n$) are output.

Figure 4:
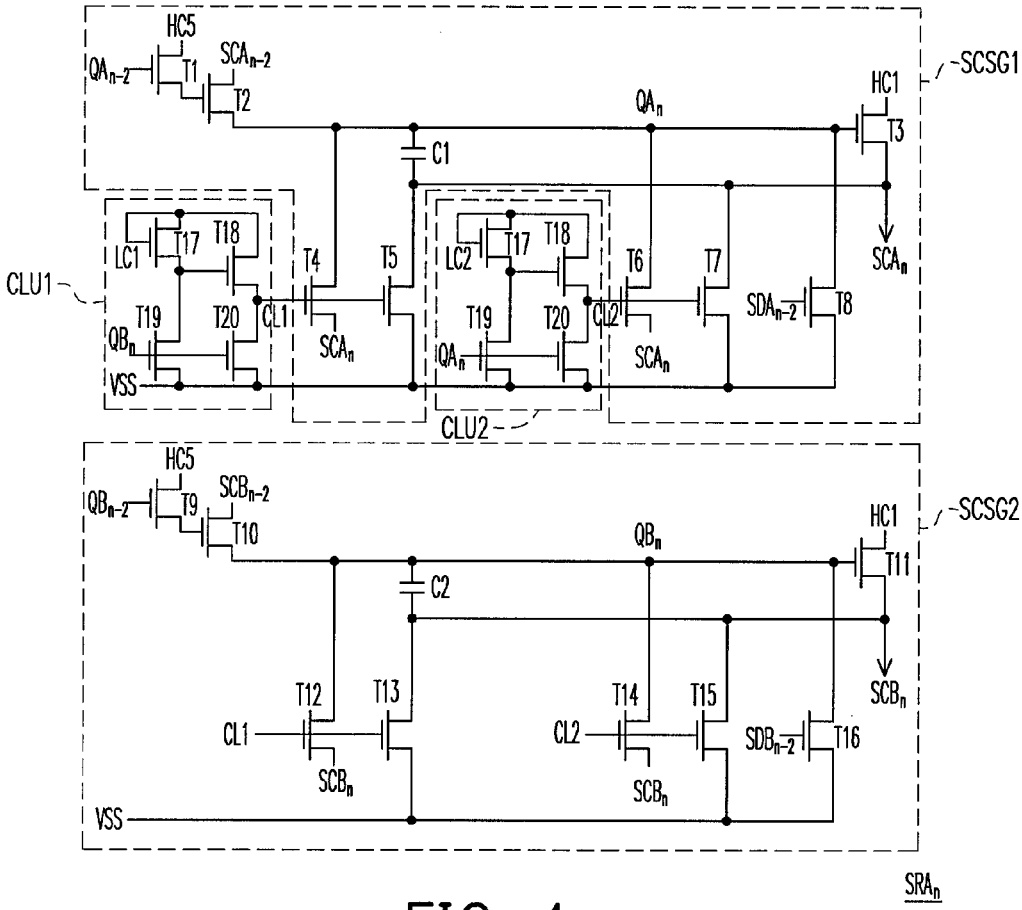
FIG. 4 is a schematic diagram illustrating circuits in the first shift registers $SRA_3$~$SRA_n$ shown in FIG. 1 according to an embodiment of the invention.

FIG. 4 is a schematic diagram illustrating circuits in the first shift registers $SRA_3$~$SRA_n$ shown in FIG. 1 according to an embodiment of the invention. With reference to FIG. 1 and FIG. 4, in this embodiment, the first shift register $SRA_n$ serves as an example. The first scan signal generator SCSG1 includes transistors T1~T8 and a capacitor C1. The drain of the transistor T1 receives the clock signal HC5, and the gate of the transistor T1 receives a terminal voltage $QA_{n-2}$ of the first shift register $SRA_{n-2}$. The drain of the transistor T2 electrically receives the first scan signal $SCA_{n-2}$ output by the first shift register $SRA_{n-2}$, the gate of the transistor T2 is electrically connected to the source of the transistor T1, and the source of the transistor T2 outputs the terminal voltage $QA_n$. The drain of the transistor T3 electrically receives the clock signal HC1, the gate of the transistor T3 is electrically connected to the source of the transistor T2, and the source of the transistor T3 outputs the first scan signal $SCA_n$.

The capacitor C1 is electrically connected between the gate and the source of the transistor T3. The drain of the transistor T4 is electrically connected to the gate of the transistor T3, the gate of the transistor T4 receives the first control signal CL1, and the source of the transistor T4 is electrically connected to the source of the transistor T3 to receive the first scan signal $SCA_n$. The drain of the transistor T5 is electrically connected to the source of the transistor T3, the gate of the transistor T5 receives the first control signal CL1, and the source of the transistor T5 receives a reference voltage VSS. Here, the reference voltage VSS may be a gate low voltage. The drain of the transistor T6 is electrically connected to the gate of the transistor T3, the gate of the transistor T6 receives the second control signal CL2, and the source of the transistor T6 is electrically connected to the source of the transistor T3 to receive the first scan signal $SCA_n$.

The drain of the transistor T7 is electrically connected to the source of the transistor T3, the gate of the transistor T7 receives the second control signal CL2, and the source of the transistor T7 receives the reference voltage VSS. The drain of the transistor T8 is electrically connected to the gate of the transistor T3, the gate of the transistor T8 receives the first driving signal $SDA_{n-2}$ output by the second shift register $SRB_{n-2}$, and the source of the transistor T8 receives the reference voltage VSS.

The second scan signal generator SCSG2 includes transistors T9~T16 and a capacitor C2. The drain of the transistor T9 receives the clock signal HC5, and the gate of the transistor T9 receives the terminal voltage $QB_{n-2}$ of the first shift register $SRA_{n-2}$. The drain of the transistor T10 electrically receives the second scan signal $SCB_{n-2}$ output by the first shift register $SRA_{n-2}$, the gate of the transistor T10 is electrically connected to the source of the transistor T9, and the source of the transistor T10 outputs the terminal voltage $QB_n$. The drain of the transistor T11 electrically receives the clock signal HC1, the gate of the transistor T11 is electrically connected to the source of the transistor T10, and the source of the transistor T11 outputs the second scan signal $SCB_n$.

The capacitor C2 is electrically connected between the gate and the source of the transistor T11. The drain of the transistor T12 is electrically connected to the gate of the transistor T11, the gate of the transistor T12 receives the first control signal CL1, and the source of the transistor T12 is electrically connected to the source of the transistor T11 to receive the second scan signal $SCB_n$. The drain of the transistor T13 is electrically connected to the source of the transistor T11, the gate of the transistor T13 receives the first control signal CL1, and the source of the transistor T13 receives the reference voltage VSS. The drain of the transistor T14 is electrically connected to the gate of the transistor T11, the gate of the transistor T14 receives the second control signal CL2, and the source of the transistor T14 is electrically connected to the source of the transistor T11 to receive the second scan signal $SCB_n$.

The drain of the transistor T15 is electrically connected to the source of the transistor T11, the gate of the transistor T15 receives the second control signal CL2, and the source of the transistor T15 receives the reference voltage VSS. The drain of the transistor T16 is electrically connected to the gate of the transistor T11, the gate of the transistor T16 receives the second driving signal $SDB_{n-2}$ output by the second shift register $SRB_{n-2}$, and the source of the transistor T16 receives the reference voltage VSS.

The first control unit CLU1 includes transistors T17~T20. The gate of the transistor T17 is electrically connected to the drain of the transistor T17 and receives the first latch clock signal LC1. The drain of the transistor T18 is electrically connected to the drain of the transistor T17, the gate of the transistor T18 is electrically connected to the source of the transistor T17, and the source of the transistor T18 outputs the first control signal CL1. The drain of the transistor T19 is electrically connected to the source of the transistor T17, the gate of the transistor T19 receives the terminal voltage $QB_n$ of the second signal generator SCSG2, and the source of the transistor T19 receives the reference voltage VSS. The drain of the transistor T20 is electrically connected to the source of the transistor T18, the gate of the transistor T20 is electrically connected to the gate of the transistor T19, and the source of the transistor T20 receives the reference voltage VSS.

The circuitry structure of the second control unit CLU2 is similar to the circuitry structure of the first control unit CLU1. The difference therebetween lies in that the gate of the transistor T17 of the second control unit CLU2 receives the second latch clock signal LC2, and the gate of the transistor T19 of the second control unit CLU2 receives the terminal voltage $QA_n$ of the first scan signal generator SCSG1.

The high-level clock signals HC1~HC6, the high-level first scan signals (e.g., $SCA_1$~$SCA_n$), and the high-level second scan signals (e.g., $SCB_1$~$SCB_n$) are overlapped with the previous high-level signals. Hence, according to the terminal voltages QA and QB of the first shift register (e.g., $SRA_1$~$SRB_n$) at the second preceding stage and the first scan signal (e.g., $SCA_1$~$SCA_n$) and the second scan signal (e.g., $SCB_1$~$SCB_n$) output by the first shift register (e.g., $SRA_1$~$SRB_n$) at the second preceding stage, the first scan signal generator SCSG1 and the second scan signal generator SCSG2, when being ready, may generate the first scan signals (e.g., $SCA_1$~$SCA_n$) and the second scan signals (e.g., $SCB_1$~$SCB_n$). Based on the above, the embodiment depicted in FIG. 4 is applicable to the first shift registers $SRA_3$~$SRA_n$.

With reference to FIG. 3 and FIG. 4, in this embodiment, the first scan signal generator SCSG1 of the first shift register $SRA_3$ serves as an example. The drain of the transistor T1 receives the clock signal HC1, the gate of the transistor T1 receives the terminal voltage $QA_1$, the drain of the transistor T2 receives the first scan signal $SCA_1$, and the drain of the transistor T3 receives the clock signal HC3. When the first shift register $SRA_1$ is turned on, the transistor T1 is switched on. Next, when the first shift register $SRA_1$ receives the high-level clock signal HC1, the transistor T2 is switched on, and the high-level first scan signal $SCA_1$ output by the first shift register $SRA_1$ charges the capacitor C1, so as to raise the terminal voltage $QA_3$.

If the terminal voltage $QA_3$ is greater than a threshold voltage, the transistor T3 is switched on, and so are the transistors T19 and T20 of the first and second control units CLU1 and CLU2. At this time, the first control unit CLU1 and the second control unit CLU2 respectively generate a low-level first control signal CL1 and a low-level second control signal CL2, such that the transistors T4, T5, T6, and T7 are switched off. When the drain of the transistor T3 receives the high-level clock signal HC3, the drain of the transistor T3 outputs the high-level first scan signal $SCA_3$. After that, when the gate of the transistor T8 receives the high-level first driving signal $SDA_1$, the transistor T8 is switched on, and the terminal voltage $QA_3$ is pulled down to the reference voltage VSS (deemed equivalent to the low level). When the terminal voltage $QA_3$ is the low-level voltage, the transistor T3 is switched off, and neither are the transistors T19 and T20 of the first and second control units CLU1 and CLU2.

In this embodiment, if the first latch clock signal LC1 is a high-level signal, the transistors T17 and T18 of the first control unit CLU1 are switched on, so as to output the high-level first control signal CL1. If the second latch clock signal LC2 is a high-level signal, the transistors T17 and T18 of the second control unit CLU2 are switched on, so as to output the high-level second control signal CL2. When the first control unit CLU1 outputs the high-level first control signal CL1, the transistors T4 and T5 pull down the terminal voltage $QA_3$ and discharge the capacitor C1. When the second control unit CLU2 outputs the high-level second control signal CL2, the transistors T6 and T7 pull down the terminal voltage $QA_3$ and discharge the capacitor C1. Based on the above, it can be ensured that the transistor T3 is not switched on by the coupling voltage, and thereby the first scan signal generator SCSG1 outputs the low-level first scan signal $SCA_3$.

The difference between the first scan signal generator SCSG1 and the second scan signal generator SCSG2 lies in that the gate of the transistor T9 receives the terminal voltage $QB_1$, and that the drain of the transistor T10 receives the second scan signal $SCB_1$. Since the high-level first scan signal $SCA_1$ and the high-level second scan signal $SCA_2$ are output simultaneously, the terminal voltages $QA_1$ and $QB_1$ are the same. Based on the above, given the circuitry structure of the first scan signal generator SCSG1 is similar to the circuitry structure of the second scan signal generator SCSG2, the second scan signal generator SCSG2 and the first scan signal generator SCSG1 are operated in a similar way. Compared to the first scan signal generator SCSG1, the second scan signal generator SCSG2 does not have the first and second control units CLU1 and CLU2. Thus, the second scan signal generator SCSG2 has a relatively simple circuitry structure, and the circuit area is reduced.

Figure 5:
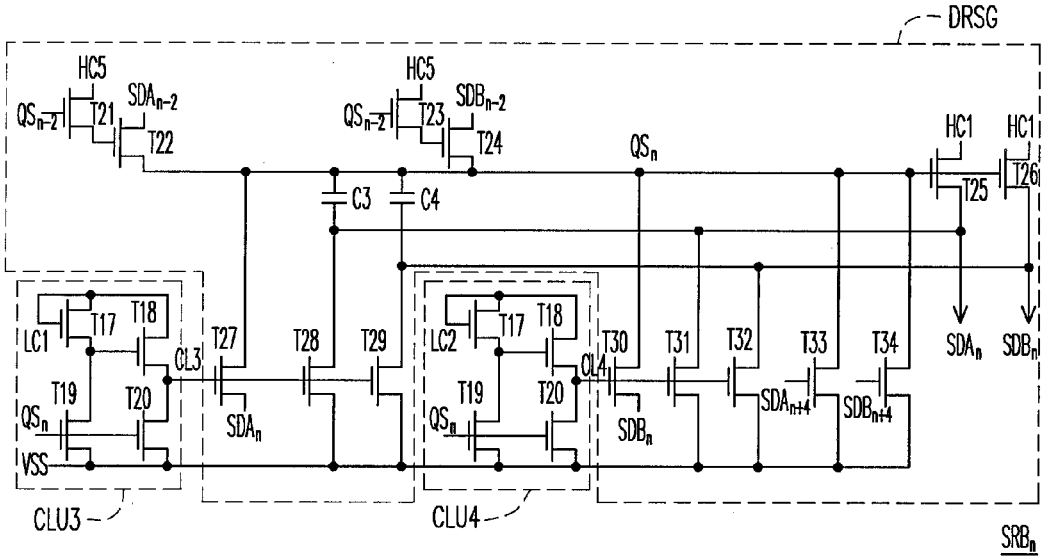
FIG. 5 is a schematic diagram illustrating circuits in the second shift registers $SRB_1$~$SRB_n$ shown in FIG. 1 according to an embodiment of the invention.

FIG. 5 is a schematic diagram illustrating circuits in the second shift registers $SRB_1$~$SRB_n$ shown in FIG. 1 according to an embodiment of the invention. With reference to FIG. 1 and FIG. 5, in this embodiment, the second shift register $SRB_n$ serves as an example, and the circuitry structure of the backup shift registers $DSR_3$~$DSR_6$ is similar to the circuitry structure of the second shift registers $SRB_1$~$SRB_n$. The driving signal generator DRSG includes transistors T21~T34 and capacitors C3 and C4. The drain of the transistor T21 receives the clock signal HC5, and the gate of the transistor T21 receives the terminal voltage $QS_{n-2}$ of the second shift register $SRB_{n-2}$. The drain of the transistor T22 electrically receives the first driving signal $SDA_{n-2}$ output by the second shift register $SRB_{n-2}$, the gate of the transistor T22 is electrically connected to the source of the transistor T21, and the source of the transistor T22 outputs the terminal voltage $QS_n$.

The drain of the transistor T23 receives the clock signal HC5, and the gate of the transistor T23 receives the terminal voltage $QS_{n-2}$ of the second shift register $SRB_{n-2}$. The drain of the transistor T24 electrically receives the second driving signal $SDB_{n-2}$ output by the second shift register $SRB_{n-2}$, the gate of the transistor T24 is electrically connected to the source of the transistor T23, and the source of the transistor T24 is electrically connected to the source of the transistor T22. The drain of the transistor T25 receives the clock signal HC1, the gate of the transistor T25 is electrically connected to the source of the transistor T22, and the source of the transistor T25 outputs the first driving signal $SDA_n$. The drain of the transistor T26 receives the clock signal HC1, the gate of the transistor T26 is electrically connected to the gate of the transistor T25, and the source of the transistor T26 outputs the second driving signal $SDB_n$.

The capacitors C3 and C4 are respectively electrically connected between the gates and the sources of the transistors T25 and T26. The drain of the transistor T27 is electrically connected to the gate of the transistor T25, the gate of the transistor T27 receives the third control signal CL3, and the source of the transistor T27 is electrically connected to the source of the transistor T25 to receive the first driving signal $SDA_n$. The drain of the transistor T28 is electrically connected to the source of the transistor T25, the gate of the transistor T28 receives the third control signal CL3, and the source of the transistor T28 receives the reference voltage VSS. The drain of the transistor T29 is electrically connected to the source of the transistor T26, the gate of the transistor T29 receives the third control signal CL3, and the source of the transistor T29 receives the reference voltage VSS.

The drain of the transistor T30 is electrically connected to the gate of the transistor T25, the gate of the transistor T30 receives the fourth control signal CL4, and the source of the transistor T30 is electrically connected to the source of the transistor T26 to receive the second driving signal $SDB_n$. The drain of the transistor T31 is electrically connected to the source of the transistor T25, the gate of the transistor T31 receives the fourth control signal CL4, and the source of the transistor T31 receives the reference voltage VSS. The drain of the transistor T32 is electrically connected to the source of the transistor T26, the gate of the transistor T32 receives the fourth control signal CL4, and the source of the transistor T32 receives the reference voltage VSS.

The drain of the transistor T33 is electrically connected to the gate of the transistor T25, the gate of the transistor T33 receives the first driving signal $SDA_{n+4}$ output by the second shift register $SRB_{n+4}$, and the source of the transistor T33 receives the reference voltage VSS. The drain of the transistor T34 is electrically connected to the gate of the transistor T26, the gate of the transistor T34 receives the second driving signal $SDB_{n+4}$ output by the second shift register $SRB_{n+4}$, and the source of the transistor T34 receives the reference voltage VSS.

With reference to FIG. 4 and FIG. 5, the circuitry structure of the third control unit CLU3 is similar to the circuitry structure of the first control unit CLU1. The difference therebetween lies in that the gate of the transistor T19 of the third control unit CLU3 receives the terminal voltage $QS_n$ of the driving signal generator DRSG. The circuitry structure of the fourth control unit CLU4 is similar to the circuitry structure of the second control unit CLU2. The difference therebetween lies in that the gate of the transistor T19 of the fourth control unit CLU4 receives the terminal voltage $QS_n$ of the driving signal generator DRSG.

With reference to FIG. 3 and FIG. 5, in this embodiment, the driving signal generator DRSG of the second shift register $SRB_1$ serves as an example. The drains of the transistors T21 and T23 receive the clock signal HC5, the gates of the transistors T21 and T23 receive the terminal voltage $QS_{-2}$, the drain of the transistor T22 receives the first driving signal $SDA_{-2}$, the drain of the transistor T23 receives the second driving signal $SDB_{-2}$, and the drains of the transistors T25 and T26 receive the clock signal HC1. When the second shift register $SRB_1$ is turned on, the transistors T21 and T23 are switched on. Next, when the second shift register $SRB_1$ receives the high-level clock signal HC5, the transistors T21 and T23 are switched on, and the high-level first driving signal $SDA_{-2}$ and the high-level second driving signal $SDB_{-2}$ output by the backup shift register $DSR_4$ charge the capacitors C3 and C4, so as to raise the terminal voltage $QS_1$.

If the terminal voltage $QS_1$ is greater than a threshold voltage, the transistors T25 and T26 are switched on, and so are the transistors T19 and T20 of the third and fourth control units CLU3 and CLU4. At this time, the third control unit CLU3 and the fourth control unit CLU4 respectively generate a low-level third control signal CL3 and a low-level fourth control signal CL4, such that the transistors T27, T28, T29, T30, T31, and T32 are switched off. When the drains of the transistors T25 and T26 receive the high-level clock signal HC1, the drain of the transistor T25 outputs the high-level first driving signal $SDA_1$, and the drain of the transistor T26 outputs the high-level second driving signal $SDB_1$. After that, when the gate of the transistor T33 receives the high-level first driving signal $SDA_5$, and/or the gate of the transistor T34 receives the high-level second driving signal $SDB_5$, at least one of the transistors T33 and T34 is switched on, and the terminal voltage $QS_1$ is pulled down to the reference voltage VSS. At this time, the transistors T25 and T26 are switched off, and neither are the transistors T19 and T20 of the third and fourth control units CLU3 and CLU4.

If the first latch clock signal LC1 is a high-level signal, the transistors T17 and T18 of the third control unit CLU3 are switched on, so as to output the high-level third control signal CL3. If the second latch clock signal LC2 is a high-level signal, the transistors T17 and T18 of the fourth control unit CLU4 are switched on, so as to output the high-level fourth control signal CL4. When the third control unit CLU3 outputs the high-level third control signal CL3, the transistors T27, T28, and T29 pull down the terminal voltage $QS_1$ and discharge the capacitors C3 and C4. When the fourth control unit CLU4 outputs the high-level fourth control signal CL4, the transistors T30, T31, and T32 pull down the terminal voltage $QS_1$ and discharge the capacitors C3 and C4. Based on the above, it can be ensured that the transistors T25 and T26 are not switched on by the coupling voltage, and thereby the driving signal generator DRSG outputs the low-level first driving signal $SDA_1$ and the low-level second driving signal $SDB_1$.

Figure 6:
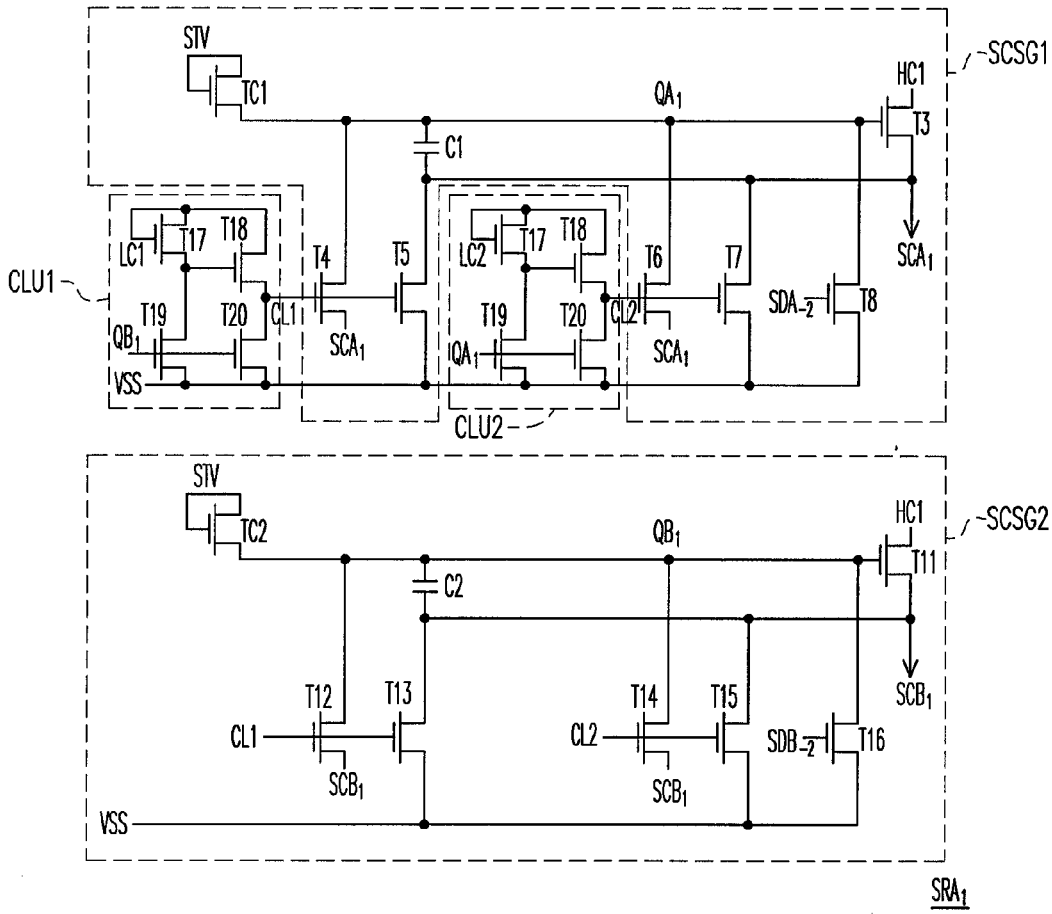
FIG. 6 is a schematic diagram illustrating circuits in the first shift registers $SRA_1$ and $SRA_2$ shown in FIG. 1 according to an embodiment of the invention.

FIG. 6 is a schematic diagram illustrating circuits in the first shift registers $SRA_1$ and $SRA_2$ shown in FIG. 1 according to an embodiment of the invention. With reference to FIG. 1, FIG. 4, and FIG. 6, in this embodiment, the first shift registers $SRA_1$ and $SRA_2$ do not have the reference first shift register at the previous stage, the circuitry structure of the first shift registers $SRA_1$ and $SRA_2$ is different from the circuitry structure of the first shift registers $SRA_3$~$SRA_n$. In this embodiment, the first shift register $SRA_1$ serves as an example. The difference between the first shift registers $SRA_1$ and $SRA_n$ lies in that the transistor TC1 is taken to replace the transistors T1 and T2, and that the transistor TC2 is taken to replace the transistors T9 and T10. The gates of the transistors TC1 and TC2 receive the start signal STV, the drain of the transistor TC1 is electrically connected to the gate of the transistor TC1, and the drain of the transistor TC2 is electrically connected to the gate of the transistor TC2. Based on the above, when the gate of the transistor TC1 receives the high-level start signal STV, the transistor TC1 is switched on, and the high-level start signal STV charges the capacitor C1; when the gate of the transistor TC2 receives the high-level start signal STV, the transistor TC2 is switched on, and the high-level start signal STV charges the capacitor C2.

Figure 7:
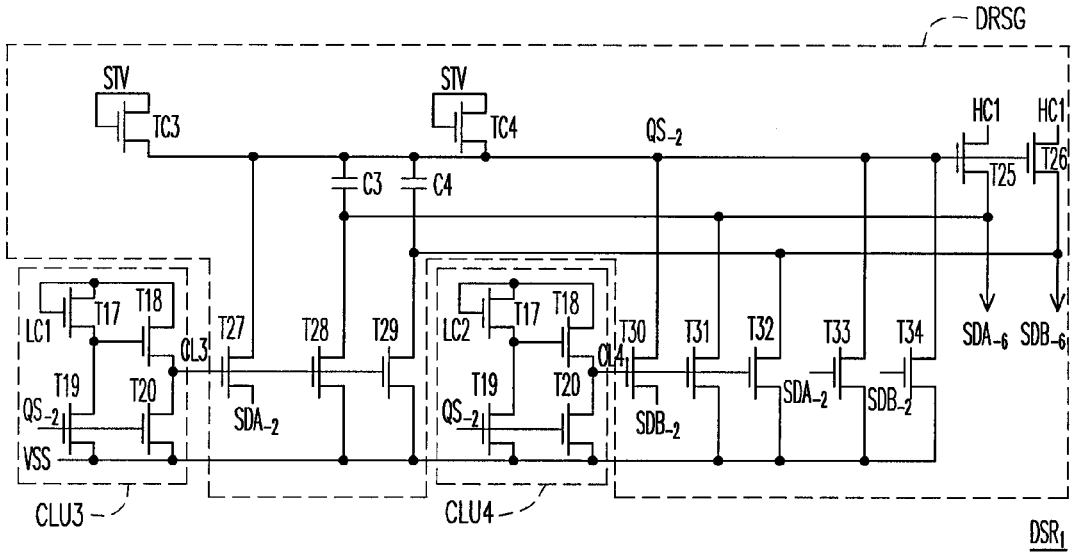
FIG. 7 is a schematic diagram illustrating circuits in the backup shift registers shown in FIG. 1 according to an embodiment of the invention.

FIG. 7 is a schematic diagram illustrating circuits in the backup shift registers shown in FIG. 1 according to an embodiment of the invention. With reference to FIG. 1, FIG. 5, and FIG. 7, in this embodiment, the backup shift registers $DSR_1$ and $DSR_2$ do not have the reference backup shift register at the previous stage, the circuitry structure of the backup shift registers $DSR_1$ and $DSR_2$ is different from the circuitry structure of the second shift registers $SRB_1$~$SRB_n$ and the circuitry structure of the backup shift registers $DSR_3$~$DSR_6$. In this embodiment, the backup shift register $DSR_1$ serves as an example. The difference between the backup shift register $DSR_1$ and the second shift register $DSR_n$ lies in that the transistor TC3 is taken to replace the transistors T21 and T22, and that the transistor TC4 is taken to replace the transistors T23 and T24. The gates of the transistors TC3 and TC4 receive the start signal STV, the drain of the transistor TC3 is electrically connected to the gate of the transistor TC3, and the drain of the transistor TC4 is electrically connected to the gate of the transistor TC4. Based on the above, when the gate of the transistor TC3 receives the high-level start signal STV, the transistor TC3 is switched on, and the high-level start signal STV charges the capacitors C3 and C4; when the gate of the transistor TC4 receives the high-level start signal STV, the transistor TC4 is switched on, and the high-level start signal STV charges the capacitors C3 and C4.

In addition, a display can be formed by the display panel 100 described in the embodiments of the invention, a timing controller, a source driver, and a backlight module.

In light of the foregoing, each of the first shift registers in the display panel and its gate driving circuit includes a first scan signal generator that generates a first scan signal and a second scan signal generator that generates a second scan signal. Besides, each of the first shift registers shares a first control unit and a second control unit. Thereby, the abatement of signal intensity of the first scan signal and the second scan signal caused by circuit sharing can be precluded, and a chip area occupied by each of the first shift registers can be reduced. Besides, the same gate driving circuit can be configured at both sides of the pixel array PAX to enhance the signal intensity of the scan signals and the driving signals. Moreover, the optical effects achieved in the display regions of the first and second pixels are respectively controlled by the first and second pixels based on the corresponding first and second driving signals, so as to alleviate the color washout phenomenon.

It will be apparent to those skilled in the art that various modifications and variations can be made to the structure of the invention without departing from the scope or spirit of the invention. In view of the foregoing, it is intended that the disclosure cover modifications and variations of this invention provided they fall within the scope of the following claims and their equivalents.

What is claimed is:

1. A gate driving circuit located on a substrate, the gate driving circuit being suitable for driving a pixel array having a plurality of first pixels and a plurality of second pixels, each of the first pixels being electrically connected to one of a plurality of first scan lines, one of a plurality of first data lines, and one of a plurality of first driving lines, each of the second pixels being electrically connected to one of a plurality of second scan lines, one of a plurality of second data lines, and one of a plurality of second driving lines, the gate driving circuit comprising:

a plurality of first shift registers, each of the first shift registers comprising:

a first scan signal generator and a second scan signal generator electrically connected to a corresponding one of the first scan lines and a corresponding one of the second scan lines, respectively, so as to simultaneously output a first scan signal to the corresponding first scan line and output a second scan signal to the corresponding second scan line according to a plurality of clock signals; and a first control unit for generating a first control signal based on a first latch clock signal and a second control unit for generating a second control signal based on a second latch clock signal, the first control signal and the second control signal being transmitted to the first scan signal generator and the second scan signal generator, respectively, so as to control the first scan signal generator and the second scan signal generator to stop outputting the first scan signal and the second scan signal; and a plurality of second shift registers, each of the second shift registers comprising:

a driving signal generator electrically connected to a corresponding one of the first driving lines and a corresponding one of the second driving lines for simultaneously outputting a first driving signal to the corresponding first driving line and outputting a second driving signal to the corresponding second driving line according to the clock signals; and a third control unit for generating a third control signal based on the first latch clock signal and a fourth control unit for generating a fourth control signal based on the second latch clock signal, the third control signal and the fourth control signal being transmitted to the driving signal generator, so as to control the driving signal generator to stop outputting the first driving signal and the second driving signal.

2. The gate driving circuit as recited in claim 1, wherein a first scan signal generator of an $n^{th}$ first shift register of the first shift registers comprises:

a first transistor having a drain for receiving a first clock signal of the clock signals and a gate for receiving a first terminal voltage of an $(n-2)^{th}$ first shift register of the first shift registers;

a second transistor having a drain for electrically receiving a first scan signal output by the $(n-2)^{th}$ first shift register, a gate being electrically connected to a source of the first transistor, and a source for outputting the first terminal voltage of the $n^{th}$ first shift register;

a third transistor having a drain for receiving a second clock signal of the clock signals, a gate being electrically connected to the source of the second transistor, and a source for outputting a corresponding one of the first scan signals;

a first capacitor electrically connected between the gate and the source of the third transistor;

a fourth transistor having a drain being electrically connected to the gate of the third transistor, a gate for receiving the first control signal, and a source being electrically connected to the source of the third transistor;

a fifth transistor having a drain being electrically connected to the source of the third transistor, a gate for receiving the first control signal, and a source for receiving a reference voltage;

a sixth transistor having a drain being electrically connected to the gate of the third transistor, a gate for receiving the second control signal, and a source being electrically connected to the source of the third transistor;

a seventh transistor having a drain of the seventh transistor being electrically connected to the source of the third transistor, a gate for receiving the second control signal, and a source for receiving the reference voltage;

an eighth transistor having a drain being electrically connected to the gate of the third transistor, a gate for receiving a first driving signal output by an $(n-2)^{th}$ second shift register of the second shift registers, and a source for receiving the reference voltage, wherein n is a positive integer greater than or equal to 1.

3. The gate driving circuit as recited in claim 2, wherein a second scan signal generator of the $n^{th}$ first shift register comprises:

a ninth transistor having a drain for receiving the first clock signal, a gate for receiving a second terminal voltage of the $(n-2)^{th}$ first shift register, and a source;

a tenth transistor having a drain for receiving a second scan signal output by the $(n-2)^{th}$ first shift register, a gate being electrically connected to the source of the ninth transistor, a source of the tenth transistor outputting the second terminal voltage of the $n^{th}$ first shift register;

an eleventh transistor having a drain for receiving a second clock signal of the clock signals, a gate being electrically connected to the source of the tenth transistor, and a source for outputting a corresponding one of the second scan signals;

a second capacitor electrically connected between the gate and the source of the eleventh transistor;

a twelfth transistor having a drain being electrically connected to the gate of the eleventh transistor, a gate for receiving the first control signal, and a source being electrically connected to the source of the eleventh transistor;

a thirteenth transistor having a drain being electrically connected to the source of the eleventh transistor, a gate for receiving the first control signal, and a source for receiving the reference voltage;

a fourteenth transistor having a drain being electrically connected to the gate of the eleventh transistor, a gate for receiving the second control signal, and a source being electrically connected to the source of the eleventh transistor;

a fifteenth transistor having a drain being electrically connected to the source of the eleventh transistor, a gate for receiving the second control signal, and a source for receiving the reference voltage; and a sixteenth transistor having a drain being electrically connected to the gate of the eleventh transistor, a gate for receiving a second driving signal output by the $(n-2)^{th}$ second shift register, and a source for receiving the reference voltage.

4. The gate driving circuit as recited in claim 3, wherein a driving signal generator of an $n^{th}$ second shift register of the second shift registers comprises:

a seventeenth transistor having a drain for receiving the first clock signal, a gate for receiving a third terminal voltage of the $(n-2)^{th}$ second shift register, and a source;

an eighteenth transistor having a drain for receiving a first driving signal output by the $(n-2)^{th}$ second shift register, a gate being electrically connected to the source of the seventeenth transistor, and a source for outputting the third terminal voltage of the $n^{th}$ second shift register;

a nineteenth transistor having a drain for receiving the first clock signal, a gate for receiving the third terminal voltage of the $(n-2)^{th}$ first shift register, and source;

a twentieth transistor having a drain for receiving the second driving signal output by the $(n-2)^{th}$ second shift register, a gate being electrically connected to the source of the nineteenth transistor, and a source being electrically connected to the source of the eighteenth transistor;

a twenty-first transistor having a drain for receiving the second clock signal, a gate being electrically connected to the source of the eighteenth transistor, and a source for outputting a corresponding one of first driving signals;

a twenty-second transistor having a drain for receiving the second clock signal, a gate being electrically connected to the gate of the twenty-first transistor, and a source for outputting a corresponding one of second driving signals;

a third capacitor electrically connected between the gate and the source of the twenty-first transistor;

a fourth capacitor electrically connected between the gate and the source of the twenty-second transistor;

a twenty-third transistor having a drain being electrically connected to the gate of the twenty-first transistor, a gate for receiving the third control signal, and a source being electrically connected to the source of the twenty-first transistor;

a twenty-fourth transistor having a drain being electrically connected to the source of the twenty-first transistor, a gate for receiving the third control signal, and a source for receiving the reference voltage;

a twenty-fifth transistor having a drain being electrically connected to the source of the twenty-second transistor, a gate for receiving the third control signal, and a source for receiving the reference voltage;

a twenty-sixth transistor having a drain being electrically connected to the gate of the twenty-first transistor, a gate for receiving the fourth control signal, and a source being electrically connected to the source of the twenty-second transistor;

a twenty-seventh transistor having a drain being electrically connected to the source of the twenty-first transistor, a gate for receiving the fourth control signal, and a source for receiving the reference voltage;

a twenty-eighth transistor having a drain being electrically connected to the source of the twenty-second transistor, a gate for receiving the fourth control signal, and a source for receiving the reference voltage;

a twenty-ninth transistor having a drain being electrically connected to the gate of the twenty-first transistor, a gate for receiving a first driving signal output by an $(n+4)^{th}$ second shift register of the second shift registers, and a source for receiving the reference voltage; and a thirtieth transistor having a drain being electrically connected to the gate of the twenty-second transistor, a gate for receiving a second driving signal output by the $(n+4)^{th}$ second shift register, and a source for receiving the reference voltage.

5. The gate driving circuit as recited in claim 4, wherein the first control unit, the second control unit, the third control unit, and the fourth control unit respectively comprise:

a thirty-first transistor having a drain, a gate being electrically connected to the drain of the thirty-first transistor, and a source;

a thirty-second transistor having a drain being electrically connected to the drain of the thirty-first transistor, a gate being electrically connected to the source of the thirty-first transistor, a source for correspondingly outputting one of the first control signal, the second control signal, the third control signal, and the fourth control signal;

a thirty-third transistor having a drain being electrically connected to the source of the thirty-first transistor, a gate and a source for receiving the reference voltage; and a thirty-fourth transistor having a drain being electrically connected to the source of the thirty-second transistor, a gate being electrically connected to the gate of the thirty-third transistor, and a source for receiving the reference voltage, wherein the gates of the thirty-first transistors of the first control unit and the third control unit receive the first latch clock signal, the gates of the thirty-first transistors of the second control unit and the fourth control unit receive the second latch clock signal, the gate of the thirty-third transistor of the first control unit receives the second terminal voltage of the $(n-2)^{th}$ first shift register, the gate of the thirty third transistor of the second control unit receives the first terminal voltage of the $(n-2)^{th}$ first shift register, and the gates of the thirty-third transistors of the third control unit and the fourth control unit receive the third terminal voltage of the $(n-2)^{th}$ second shift register.

6. The gate driving circuit as recited in claim 1, wherein the first scan signal and the second scan signal do not overlap a corresponding one of the first driving signals and a corresponding one of the second driving signals.

7. The gate driving circuit as recited in claim 6, wherein the first scan signal and the second scan signal are output before the corresponding first driving signal and the corresponding second driving signal are output, and there is a clock period of the clock signals between a time point at which the first and second scan signals are output and a time point at which the corresponding first and second driving signals are output.

8. The gate driving circuit as recited in claim 1, wherein the first latch clock signal is an inverted signal of the second latch clock signal.

9. A display panel comprising:

a substrate;

a plurality of first scan lines and a plurality of second scan lines located on the substrate;

a plurality of first data lines and a plurality of second data lines located on the substrate;

a plurality of first driving lines and a plurality of second driving lines located on the substrate;

a pixel array located on the substrate, the pixel array having a plurality of first pixels and a plurality of second pixels, each of the first pixels being electrically connected to one of the first scan lines, one of the first data lines, and one of the first driving lines, each of the second pixels being electrically connected to one of the second scan lines, one of the second data lines, and one of the second driving lines; and a gate driving circuit located on the substrate, the gate driving circuit comprising:

a plurality of first shift registers, each of the first shift registers comprising:

a first scan signal generator and a second scan signal generator electrically connected to a corresponding one of the first scan lines and a corresponding one of the second scan lines, respectively, so as to simultaneously output a first scan signal to the corresponding first scan line and output a second scan signal to the corresponding second scan line according to a plurality of clock signals; and a first control unit for generating a first control signal based on a first latch clock signal and a second control unit for generating a second control signal based on a second latch clock signal, the first control signal and the second control signal being transmitted to the first scan signal generator and the second scan signal generator, respectively, so as to control the first scan signal generator and the second scan signal generator to stop outputting the first scan signal and the second scan signal; and a plurality of second shift registers, each of the second shift registers comprising:

a driving signal generator electrically connected to a corresponding one of the first driving lines and a corresponding one of the second driving lines for simultaneously outputting a first driving signal to the corresponding first driving line and outputting a second driving signal to the corresponding second driving line according to the clock signals; and a third control unit for generating a third control signal based on the first latch clock signal and a fourth control unit for generating a fourth control signal based on the second latch clock signal, the third control signal and the fourth control signal being transmitted to the driving signal generator, so as to control the driving signal generator to stop outputting the first driving signal and the second driving signal.

10. The display panel as recited in claim 9, wherein a first scan signal generator of an $n^{th}$ first shift register of the first shift registers comprises:

a first transistor having a drain for receiving a first clock signal of the clock signals, a gate for receiving a first terminal voltage of an $(n-2)^{th}$ first shift register of the first shift registers, and a source;

a second transistor having a drain for receiving a first scan signal output by the$(n-2)^{th}$ first shift register, a gate being electrically connected to the source of the first transistor, and a source for outputting the first terminal voltage of the $n^{th}$ first shift register;

a third transistor having a drain for receiving a second clock signal of the clock signals, a gate being electrically connected to the source of the second transistor, and a source for outputting a corresponding one of the first scan signals;

a first capacitor electrically connected between the gate and the source of the third transistor;

a fourth transistor having a drain being electrically connected to the gate of the third transistor, a gate for receiving the first control signal, and a source being electrically connected to the source of the third transistor;

a fifth transistor having a drain being electrically connected to the source of the third transistor, a gate for receiving the first control signal, and a source for receiving a reference voltage;

a sixth transistor having a drain being electrically connected to the gate of the third transistor, a gate for receiving the second control signal, and a source being electrically connected to the source of the third transistor;

a seventh transistor having a drain being electrically connected to the source of the third transistor, a gate for receiving the second control signal, and a source for receiving the reference voltage;

an eighth transistor having a drain being electrically connected to the gate of the third transistor, a gate for receiving a first driving signal output by an $(n-2)^{th}$ second shift register of the second shift registers, and a source for receiving the reference voltage, wherein n is a positive integer greater than or equal to 1.

11. The display panel as recited in claim 10, wherein a second scan signal generator of the $n^{th}$ first shift register comprises:

a ninth transistor having a drain for receiving the first clock signal, a gate for receiving a second terminal voltage of the $(n-2)^{th}$ first shift register, and a source;

a tenth transistor having a drain for receiving a second scan signal output by the$(n-2)^{th}$ first shift register, a gate being electrically connected to the source of the ninth transistor, and a source for outputting the second terminal voltage of the $n^{th}$ first shift register;

an eleventh transistor having a drain for receiving a second clock signal of the clock signals, a gate being electrically connected to the source of the tenth transistor, and a source for outputting a corresponding one of the second scan signals;

a second capacitor electrically connected between the gate and the source of the eleventh transistor;

a twelfth transistor having a drain being electrically connected to the gate of the eleventh transistor, a gate for receiving the first control signal, and a source being electrically connected to the source of the eleventh transistor;

a thirteenth transistor having a drain being electrically connected to the source of the eleventh transistor, a gate for receiving the first control signal, and a source for receiving the reference voltage;

a fourteenth transistor having a drain being electrically connected to the gate of the eleventh transistor, a gate for receiving the second control signal, and a source being electrically connected to the source of the eleventh transistor;

a fifteenth transistor having a drain being electrically connected to the source of the eleventh transistor, a gate for receiving the second control signal, and a source for receiving the reference voltage; and a sixteenth transistor having a drain being electrically connected to the gate of the eleventh transistor, a gate for receiving a second driving signal output by the $(n-2)^{th}$ second shift register, and a source for receiving the reference voltage.

12. The display panel as recited in claim 11, wherein a driving signal generator of an $n^{th}$ second shift register of the second shift registers comprises:

a seventeenth transistor having a drain for receiving the first clock signal, a gate for receiving a third terminal voltage of the $(n-2)^{th}$ second shift register, and a source;

an eighteenth transistor having a drain for receiving a first driving signal output by the $(n-2)^{th}$ second shift register, a gate being electrically connected to the source of the seventeenth transistor, and a source for outputting the third terminal voltage of the $n^{th}$ second shift register;

a nineteenth transistor having a drain for receiving the first clock signal, a gate for receiving the third terminal voltage of the $(n-2)^{th}$ first shift register, and a source;

a twentieth transistor having a drain for receiving the second driving signal output by the $(n-2)^{th}$ second shift register, a gate being electrically connected to the source of the nineteenth transistor, and a source being electrically connected to the source of the eighteenth transistor;

a twenty-first transistor having a drain for receiving the second clock signal, a gate being electrically connected to the source of the eighteenth transistor, and a source for outputting a corresponding one of first driving signals;

a twenty-second transistor having a drain for receiving the second clock signal, a gate being electrically connected to the gate of the twenty-first transistor, and a source for outputting a corresponding one of second driving signals;

a third capacitor electrically connected between the gate and the source of the twenty-first transistor;

a fourth capacitor electrically connected between the gate and the source of the twenty-second transistor;

a twenty-third transistor having a drain being electrically connected to the gate of the twenty-first transistor, a gate for receiving the third control signal, and a source being electrically connected to the source of the twenty-first transistor;

a twenty-fourth transistor having a drain being electrically connected to the source of the twenty-first transistor, a gate for receiving the third control signal, and a source for receiving the reference voltage;

a twenty-fifth transistor having a drain being electrically connected to the source of the twenty-second transistor, a gate for receiving the third control signal, and a source for receiving the reference voltage;

a twenty-sixth transistor having a drain being electrically connected to the gate of the twenty-first transistor, a gate for receiving the fourth control signal, and a source being electrically connected to the source of the twenty-second transistor;

a twenty-seventh transistor having a drain being electrically connected to the source of the twenty-first transistor, a gate for receiving the fourth control signal, and a source for receiving the reference voltage;

a twenty-eighth transistor having a drain being electrically connected to the source of the twenty-second transistor, a gate for receiving the fourth control signal, and a source for receiving the reference voltage;

a twenty-ninth transistor having a drain being electrically connected to the gate of the twenty-first transistor, a gate for receiving a first driving signal output by an $(n+4)^{th}$ second shift register of the second shift registers, and a source for receiving the reference voltage; and a thirtieth transistor having a drain being electrically connected to the gate of the twenty-second transistor, a gate for receiving a second driving signal output by the $(n+4)^{th}$ second shift register, and a source for receiving the reference voltage.

13. The display panel as recited in claim 12, wherein the first control unit, the second control unit, the third control unit, and the fourth control unit respectively comprise:

a thirty-first transistor having a drain, a gate of the thirty-first transistor being electrically connected to the drain of the thirty-first transistor, and a source;

a thirty-second transistor having a drain being electrically connected to the drain of the thirty-first transistor, a gate being electrically connected to the source of the thirty-first transistor, and a source for correspondingly outputting one of the first control signal, the second control signal, the third control signal, and the fourth control signal;

a thirty-third transistor having a drain being electrically connected to the source of the thirty-first transistor, a gate and a source transistor receiving the reference voltage; and a thirty-fourth transistor having a drain being electrically connected to the source of the thirty-second transistor, a gate being electrically connected to the gate of the thirty-third transistor, and a source for receiving the reference voltage, wherein the gates of the thirty-first transistors of the first control unit and the third control unit receive the first latch clock signal, the gates of the thirty-first transistors of the second control unit and the fourth control unit receive the second latch clock signal, the gate of the thirty-third transistor of the first control unit receives the second terminal voltage of the $(n-2)^{th}$ first shift register, the gate of the thirty-third transistor of the second control unit receives the first terminal voltage of the $(n-2)^{th}$ first shift register, and the gates of the thirty-third transistors of the third control unit and the fourth control unit receive the third terminal voltage of the $(n-2)^{th}$ second shift register.

14. The display panel as recited in claim 9, wherein the first pixels and the second pixels respectively comprise:

a thirty-fifth transistor having a drain, a gate and a source;

a first storage capacitor electrically connected between the source of the thirty-fifth transistor and a common voltage;

a first liquid crystal capacitor electrically connected between the source of the thirty-fifth transistor and the common voltage;

a fifth capacitor and a sixth capacitor electrically connected in series between the source of the thirty-fifth transistor and the common voltage;

a thirty-sixth transistor having a drain, a gate and a source;

a second storage capacitor electrically connected between the source of the thirty-sixth transistor and the common voltage;

a second liquid crystal capacitor electrically connected between the source of the thirty-sixth transistor and the common voltage; and a thirty-seventh transistor having a drain being electrically connected to the source of the thirty-sixth transistor, a gate and a source being electrically connected between the fifth capacitor and the sixth capacitor;

wherein the gate of the thirty-fifth transistor and the gate of the thirty-sixth transistor of each of the first pixels are electrically connected to a corresponding one of the first scan lines, the drain of the thirty-fifth transistor and the drain of the thirty-sixth transistor of each of the first pixels are electrically connected to a corresponding one of the first data lines, the gate of the thirty-seventh transistor of each of the first pixels is electrically connected to a corresponding one of the first driving lines, the gate of the thirty-fifth transistor and the gate of the thirty-sixth transistor of each of the second pixels are electrically connected to a corresponding one of the second scan lines, the drain of the thirty-fifth transistor and the drain of the thirty-sixth transistor of each of the second pixels are electrically connected to a corresponding one of the second data lines, and the gate of the thirty-seventh transistor of each of the second pixels is electrically connected to a corresponding one of the second driving lines.

15. The display panel as recited in claim 9, wherein the first scan signal and the second scan signal do not overlap a corresponding one of the first driving signals and a corresponding one of the second driving signals.

16. The display panel as recited in claim 15, wherein the first scan signal and the second scan signal are output before the corresponding first driving signal and the corresponding second driving signal are output, and there is a clock period of the clock signals between a time point at which the first and second scan signals are output and a time point at which the corresponding first and second driving signals are output.

17. The display panel as recited in claim 9, wherein the first latch clock signal and the second latch clock signal are inverted.

18. The display panel as recited in claim 9, wherein the clock signals are output sequentially.

19. The display panel as recited in claim 18, wherein each of the clock signals overlaps two clock signals of the clock signals adjacent to the each of the clock signals.

20. The display panel as recited in claim 19, wherein overlapping portions between the each of the clock signals and the two adjacent clock signals are equal, and a total value of the overlapping portions between the each of the clock signals and the two adjacent clock signals is equal to a pulse width of the each of the clock signals.

* * * * *